US009095975B2

(12) United States Patent
Green

(10) Patent No.: US 9,095,975 B2
(45) Date of Patent: Aug. 4, 2015

(54) TOOL HOLDER WITH ROLLING GRIP

(71) Applicant: RB Distribution, Inc., Colmar, PA (US)

(72) Inventor: Roy Green, Philadelphia, PA (US)

(73) Assignee: RB Distribution, Inc., Colmar, PA (US)

( * ) Notice: Subject to any disclaimer, the term of this patent is extended or adjusted under 35 U.S.C. 154(b) by 64 days.

(21) Appl. No.: 13/928,068

(22) Filed: Jun. 26, 2013

(65) Prior Publication Data

US 2015/0001367 A1 Jan. 1, 2015

(51) Int. Cl.

| | |
|---|---|
| ***A46B 17/02*** | (2006.01) |
| ***B25H 3/04*** | (2006.01) |
| ***A47L 13/512*** | (2006.01) |

(52) U.S. Cl.

CPC ..... *B25H 3/04* (2013.01); *A47L 13/512* (2013.01)

(58) Field of Classification Search

CPC ..... A01K 97/10; A47L 13/512; B25H 3/04; A63D 15/10

USPC ..... 248/539, 110, 113; 211/65, 66, 68, 211/60.1, 70.6

See application file for complete search history.

(56) References Cited

U.S. PATENT DOCUMENTS

| | | | | | |
|---|---|---|---|---|---|
| 867,199 | A | * | 9/1907 | Jack | 248/113 |
| 1,393,265 | A | * | 10/1921 | Cooper | 211/68 |
| 1,674,581 | A | * | 6/1928 | Webb | 248/113 |
| 1,798,028 | A | * | 3/1931 | Nachtigal | 248/113 |
| 2,869,209 | A | * | 1/1959 | Kautzky | 248/316.3 |
| 3,013,756 | A | * | 12/1961 | Boston | 248/113 |
| 3,672,619 | A | * | 6/1972 | Bowen | 248/113 |
| 4,134,499 | A | * | 1/1979 | Joswig | 211/66 |
| 5,165,629 | A | * | 11/1992 | Breveglieri | 248/110 |
| 5,303,831 | A | * | 4/1994 | Miller | 211/66 |
| 5,342,010 | A | * | 8/1994 | Huang | 248/316.3 |
| 5,465,935 | A | * | 11/1995 | Wilbs | 248/316.3 |
| 5,992,811 | A | * | 11/1999 | McFerren et al. | 248/316.3 |
| 7,185,796 | B2 | * | 3/2007 | Parsons | 224/197 |
| 7,445,129 | B2 | * | 11/2008 | Lin | 211/70.6 |
| 2003/0080079 | A1 | * | 5/2003 | Wu | 211/89.01 |
| 2006/0208138 | A1 | * | 9/2006 | Huang | 248/110 |

* cited by examiner

*Primary Examiner* — Anita M King

(74) *Attorney, Agent, or Firm* — Volpe and Koenig, P.C.

(57) ABSTRACT

A rolling gripper for use in a housing assembly that holds stored items. The rolling gripper includes a support frame that has space apart side walls and a floor extending between the side walls, the walls have non-linear slots that are opposed to each other; and, a rolling gripper that is configured to fit between the side walls of the support frame and has fixed pins that are configured to be received and move within the non-linear slots.

5 Claims, 6 Drawing Sheets

TOOL HOLDER WITH ROLLING GRIP

FIELD OF INVENTION

This application is generally in the field of household storage products. More specifically, it is in the field of storage for tools and the like, such as brooms, shovels, dust brushes and other items generally used for gardening and other chores.

BACKGROUND

A gravity operated device for handled objects may be useful for handled objects such as brooms, mops, tools, and the like to be vertically supported side-by-side on a wall. A simple, practical, and efficient holder with use for handled objects should permit the handled object to be quickly gripped and rapidly released by movement of the handle relative to the fixed and movable gripping means of the holder.

FIG. 7 is an example of a known prior art device 700 that includes a rolling grip 705 and opposing walls 701 and 702. The rolling grip 705 has a longitudinal axis through its center and a shaft 710 that is off center with respect to the axis and generally parallel to it. The shaft 710, in addition to extending parallel to the longitudinal axis, has free ends 710 that extend beyond the ends of the rolling grip 705. The rolling grip 705 rolls up an inclined plane 715, including ramps 720, that tend to guide and lift the rolling grip 705 as it advances in the direction of the inclined plane 715. The opposed walls 701 and 702 have vertical slots 725 that are dimensioned to receive the free ends of shaft 710.

In use, the rolling grip 705 is supposed to move in the direction of the inclined plane 715 along the ramps 720 as the free ends of shaft 710 move up the vertical slots 725 to accommodate the handle as the object is set in place. When the upper movement of the handle stops and the weight of the handle is free to move downward, the rolling grip 705 is supposed to move downward in the direction of the inclined plane 715. However, it has been found that confining the free ends of the shaft 710 in a generally linear slot causes the shaft 710 to remain engaged with the slot and prevent the desired downward movement. This generally requires the user to forcibly pull the rolling grip 705 down to engage the handle.

Additionally, when the handle is removed from the prior art, the rolling grip 705 often fails to return to the neutral position because the ends of shaft 710 do not move down the vertical slot 725. Once again, the user must forcibly pull down the rolling grip 705.

SUMMARY

An item holding device that is included in a housing having a body cavity configured to receive the holding device. The holding device includes a rolling gripper that is affixed to a shaft and the ends of the shaft are positioned in non-linear slots in the opposed walls which form part of the holding device. The non-linear slots provide greater freedom of movement for the shaft as the rolling gripper is moved and greatly reduces the incidents when the rolling gripper becomes stuck.

BRIEF DESCRIPTION OF THE DRAWING(S)

DETAILED DESCRIPTION OF A PREFERRED EMBODIMENT

This invention is described with reference to the drawings wherein like reference numbers represent the same or similar elements. While this invention is described in terms of modes for achieving this invention's objectives, it will be appreciated by those skilled in the art that variations may be accomplished in view of these teachings without deviating from the spirit or scope of the invention.

Figure 1:
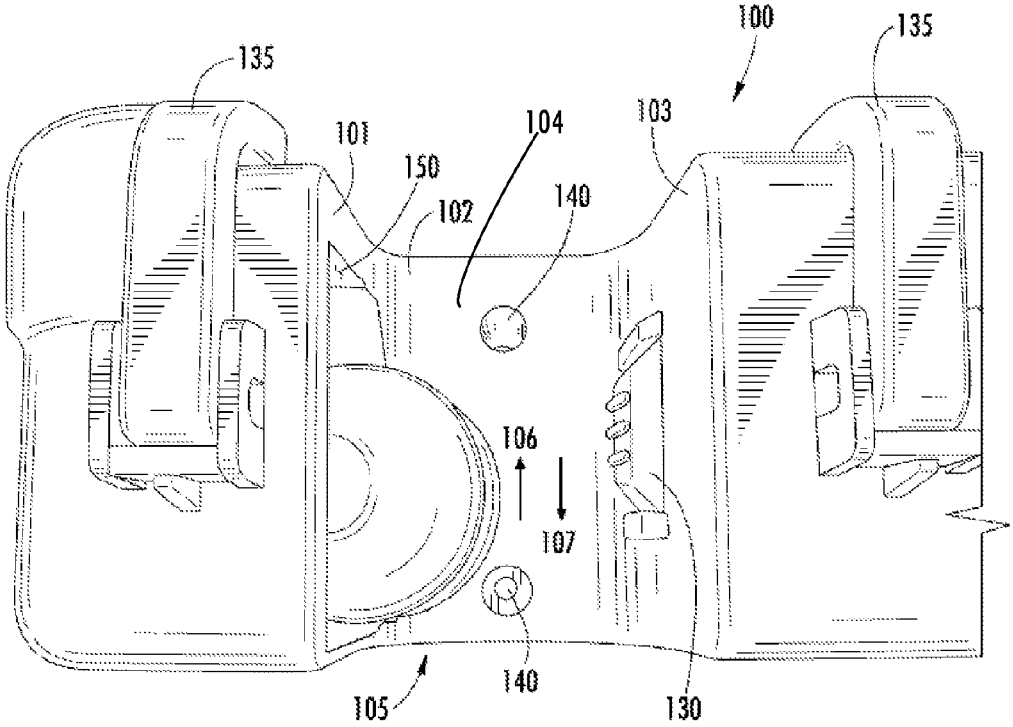
FIG. 1 is a front view of a holder housing with a rolling gripper.

FIG. 1 illustrates a rolling grip assembly 105 in the housing 100 that defines a cavity 150 for receiving the rolling grip assembly 105 and a cavity 104, defined by walls 101, 102, and 103, that provides a receiving area for the item being presented to the rolling grip. In this embodiment, a stationary opposing grip 130 is provided opposite to the rolling grip on wall 103. Optionally, hooks 135 may be provided for hanging additional items, and holes 140 provide a means for securing the housing 100 to a support structure.

In use, an item is inserted into the housing between the rolling grip assembly 105 and the stationary opposing grip 130 in the direction of arrow 106. When the item is inserted a sufficient distance into the housing 100, the rolling grip 105 moves into the cavity 150 and then rolls forward to secure the item as it is lowered in the direction of arrow 107.

Figure 2:
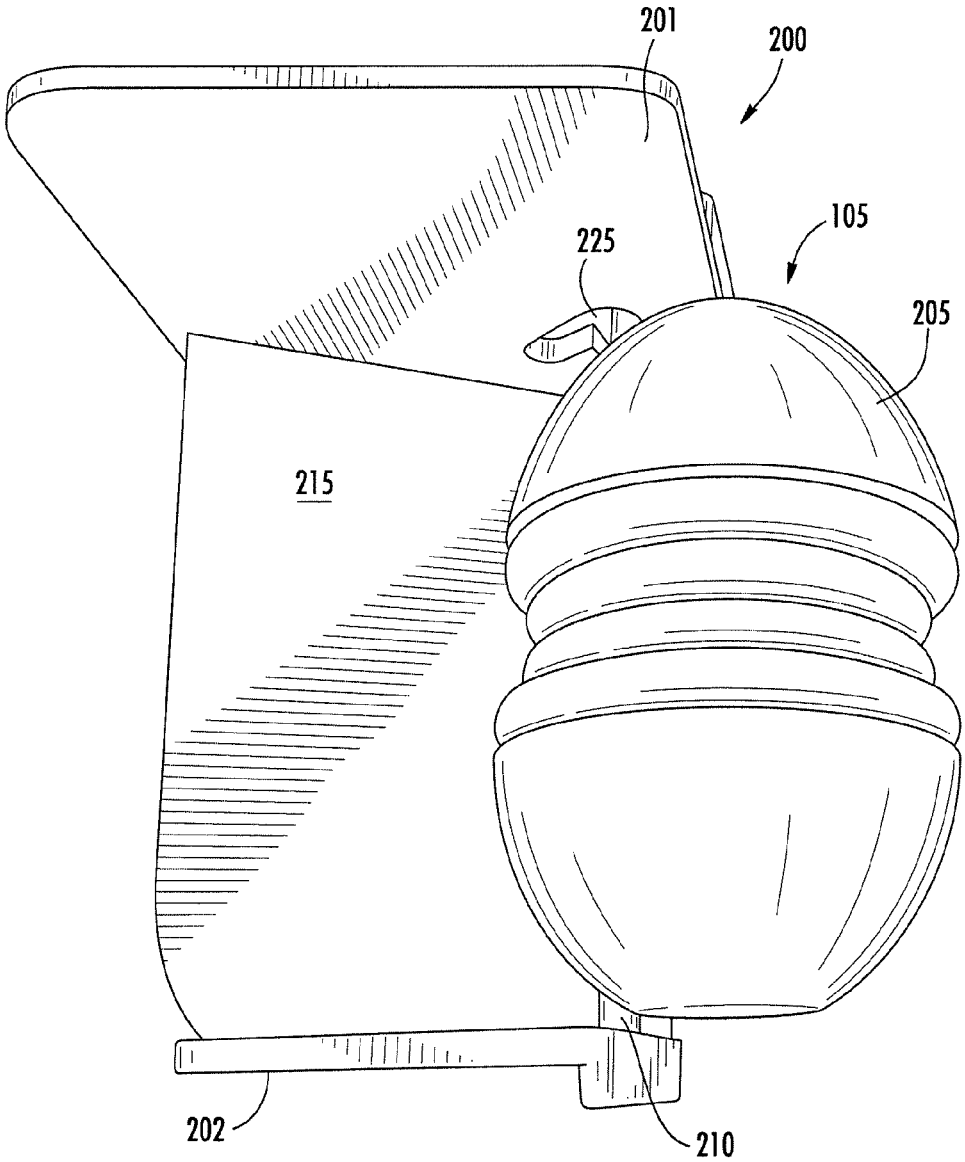
FIG. 2 is a top view of a preferred rolling gripper assembly.

FIG. 2 is a view of the rolling grip assembly 105 prior to assembly with the housing 100. The assembly 105 includes a supporting frame 200 that has opposing walls 201 and 202, each of which has a non-linear slot 225 that is preferably in an inverted "v" shape, and a floor 215 that is preferably an inclined plane. A barrel shaped rolling gripper 205 has a longitudinal central axis and is dimensioned to be positioned between the walls 201 and 202 and move up the inclined plane 215. A shaft 210 that extends parallel to the longitudinal central axis and beyond the rolling grip 205 is attached to rolling grip 205 in a position that is offset with respect to the central axis.

The ends of shaft 210 fit into the non-linear slots 225 and move freely within the slots 225. The slots 225 are positioned below the middle points, see "M" in FIG. 3, of opposing walls 201 and 202 so that when the barrel shaped rolling grip 205 is at rest on the lower end of the inclined plane 215 the ends of shaft 210 are positioned at about the lowest point of the non-linear slots. When an item is placed into a housing 100 that has the present rolling grip assembly 105, the rolling grip 205 is free to move up the inclined plane 215 without restricts caused by movement of the shaft 210 in the non-linear slots 225. Due to the fact that the shaft 210 and barrel shaped rolling grip 205 are attached to each other, the rolling grip 205 rotates with shaft 210 as shaft 210 moves in the non-linear "v" shaped slots 225. This freedom of movement during insertion of the item enables free movement of the rolling grip 205 during the downward motion to grip the inserted item. This free movement of the shaft 210 greatly reduces the incidences of the rolling grip 205 from being stuck and having to be forcibly pulled down during engagement or disengagement.

As an alternative to the shaft extending through the barrel shaped rolling gripper 205, it may be provided with outwardly projecting pins that engage the non-linear slots 225.

Figure 3:
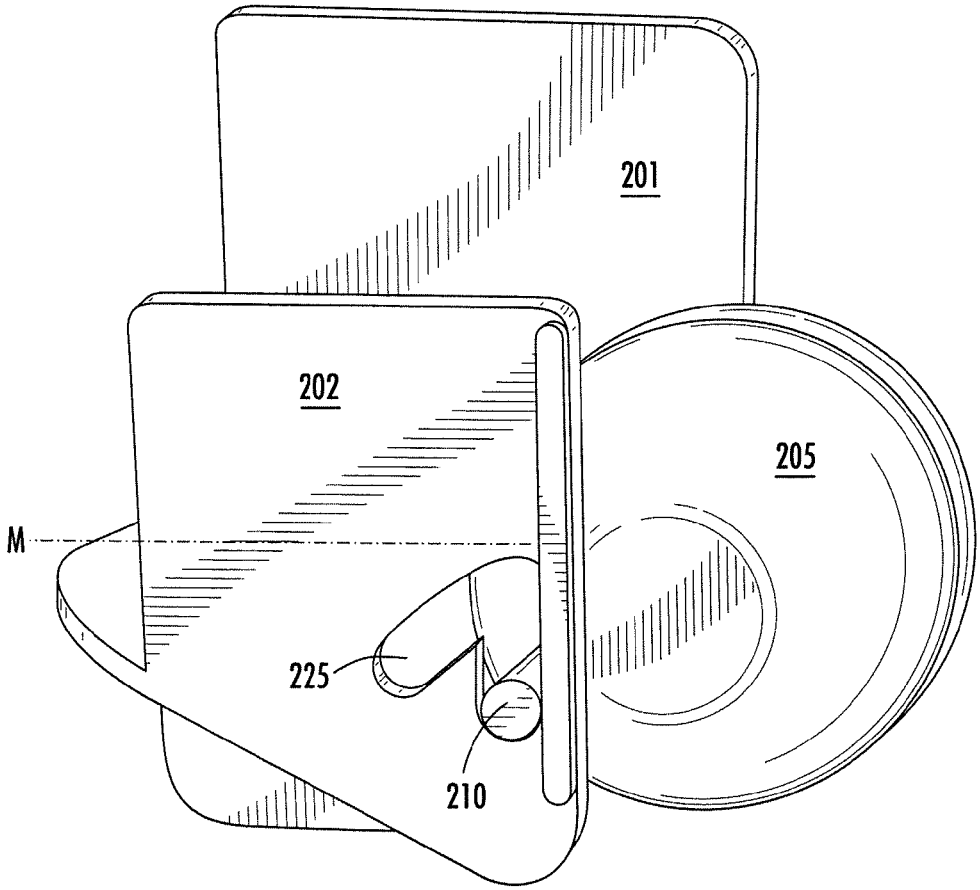
FIG. 3 is a left side view of the rolling gripper assembly of FIG. 2.
Figure 4:
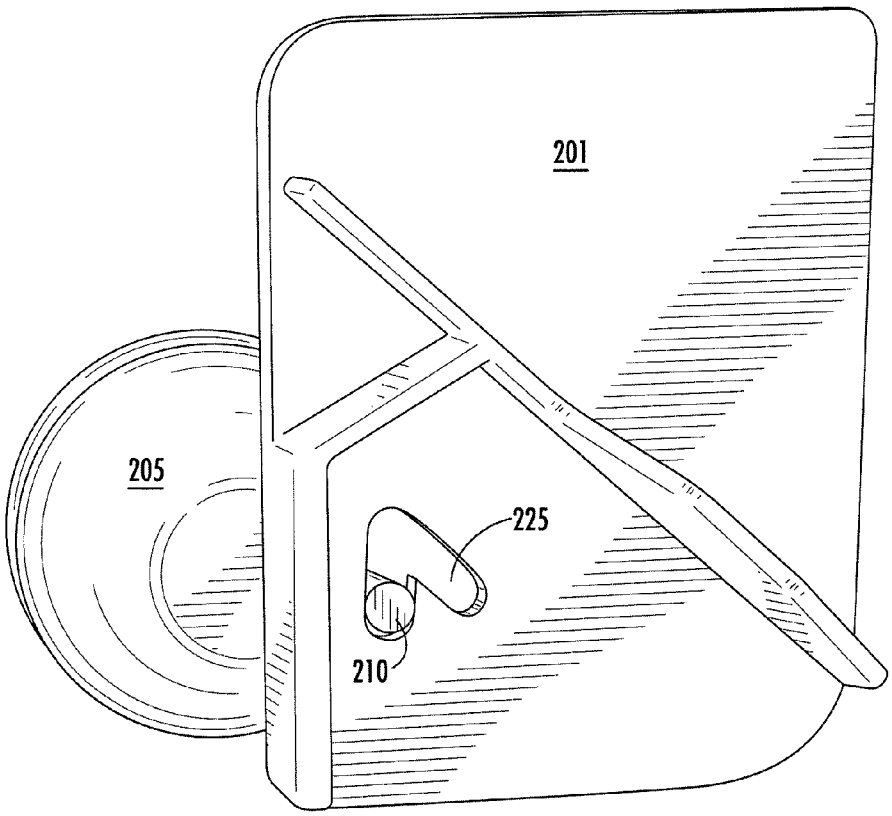
FIG. 4 is a right side view of the rolling grip assembly of FIG. 2.

FIGS. 3 and 4 show side views of rolling grip assembly 105 that is dimensioned to fit into an existing housing 100 and incorporates the preferred inverted "v" shaped slots 225.

Figure 5:
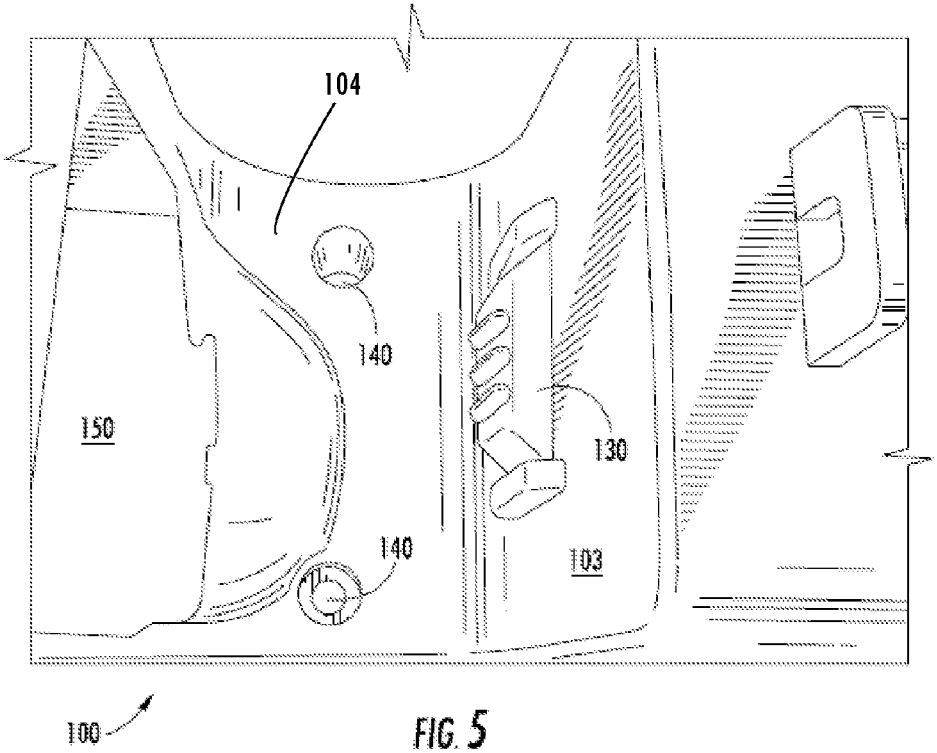
FIG. 5 is a front view of the holder housing prior to receiving a rolling gripper assembly.
Figure 6:
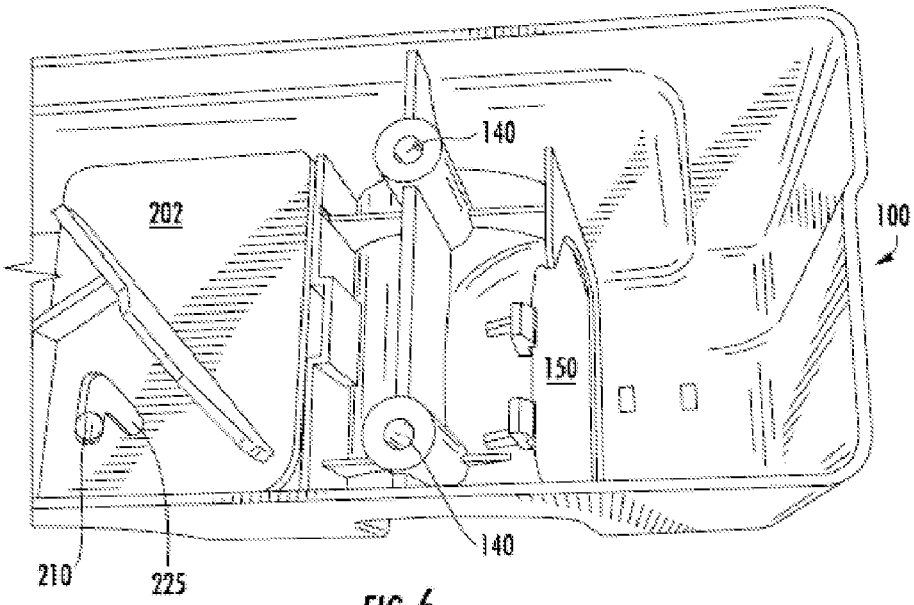
FIG. 6 is rear view of the holder housing prior to receiving a rolling gripper assembly.
Figure 7:
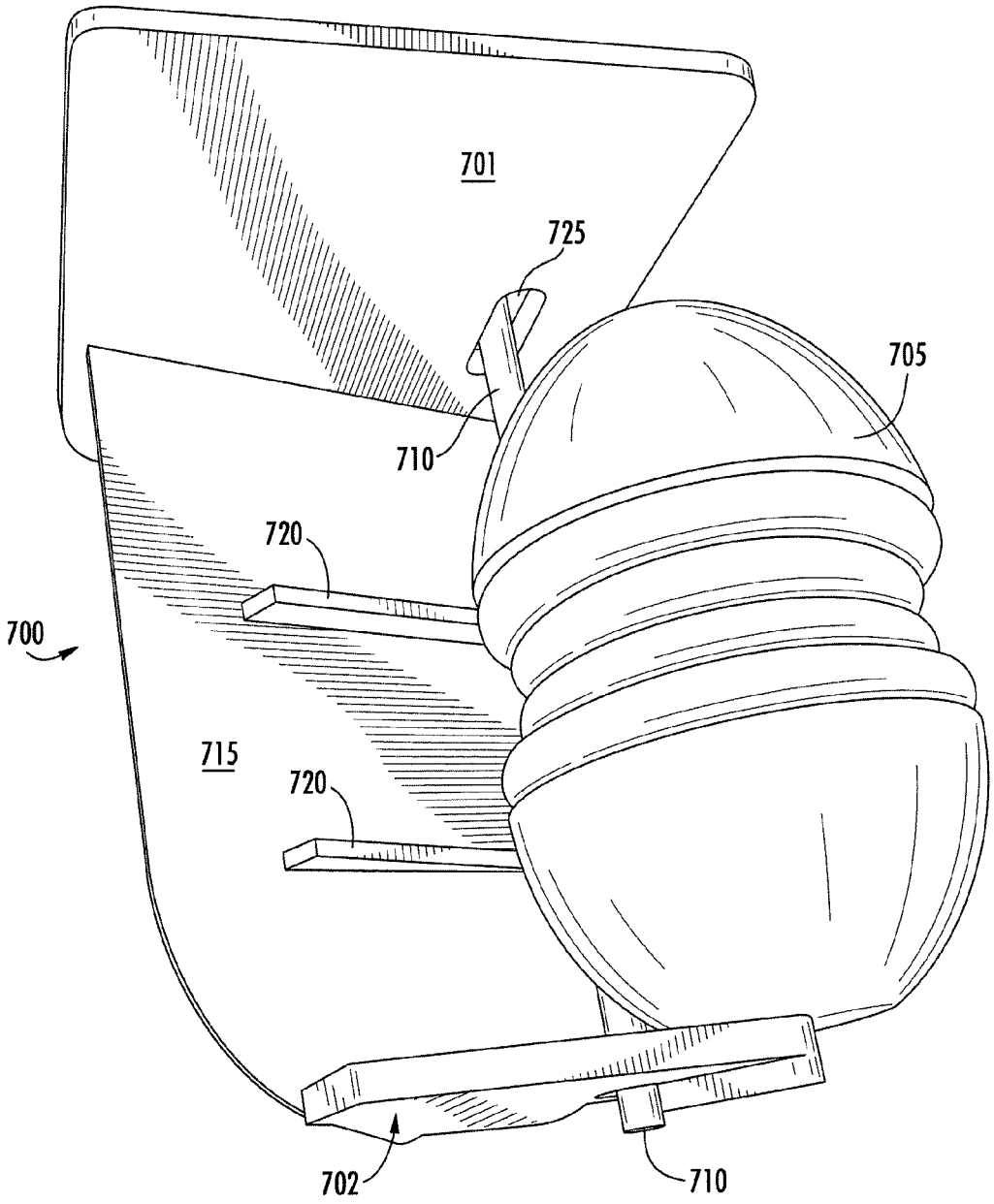
FIG. 7 (PRIOR ART)
FIG. 7 is an example of a prior art rolling griper assembly.

FIGS. 5 and 6 illustrate the front and back configuration of the cavities 104 and 150 in housing 100 prior to insertion of the rolling grip assembly 105 into the housing 100.

What is claimed is:

1. A rolling gripper assembly comprising:

a support frame that has spaced apart side walls and a floor extending between the side walls, the walls have substantially "v" shaped, non-linear slots that are opposed to each other; and, a rolling gripper that is configured to fit between the side walls of the support frame and has fixed pins that are configured to be received and move within the substantially "v" shaped, non-linear slots.

2. The rolling gripper assembly of claim 1 wherein the non-linear slots are in the shape of an inverted "v."

3. A handle holder comprising:

a housing having a body that defines at least one cavity receiving a rolling grip assembly and a stationary grip;

the rolling grip assembly includes opposed walls with substantially "v" shaped slots that are located below a midpoint on each opposed wall, and a roller body that has a fixed shaft that extends beyond the roller body and is dimensioned to fit freely within the substantially "v" shaped slot of each opposed wall;

whereby the roller body retracts into the housing when a handle is moved in a first direction between the roller body and the stationary grip, and rolls forward when the handle moves in direction opposite to the first direction.

4. The handle holder of claim 3 wherein each substantially "v" shaped slot is in the shape of an inverted "v."

5. An item holder comprising:

a housing that defines at least one receiving cavity;

a rolling gripper assembly comprising a support frame that has spaced apart side walls and a floor extending between the side walls, the walls have slots that extend out from a point of intersection and diverge from each other to form substantially "v" shaped openings; and, a rolling gripper that is configured to fit between the side walls of the support frame and has fixed pins that are configured to be received and move within the substantially "v" shaped openings, and is dimensioned for insertion into the at least one receiving cavity.

* * * * *